US012624479B2

(12) United States Patent
Cho et al.

(10) Patent No.: US 12,624,479 B2
(45) Date of Patent: May 12, 2026

(54) FLOORING WOVEN FABRIC

(71) Applicants: Hyundai Motor Company, Seoul (KR); Kia Corporation, Seoul (KR); Kolonglotech. Inc, Seoul (KR)

(72) Inventors: Hyun Dae Cho, Anyang (KR); Mi Jung Yun, Seongnam (KR); Chang Hyeon Noh, Seongnam (KR); Hyun Joung Jun, Gumi (KR); Hae Min Hwang, Gumi (KR)

(73) Assignees: Hyundai Motor Company, Seoul (KR); Kia Corporation, Seoul (KR); Kolongotech. Inc, Seoul (KR)

( * ) Notice: Subject to any disclaimer, the term of this patent is extended or adjusted under 35 U.S.C. 154(b) by 468 days.

(21) Appl. No.: 17/949,507

(22) Filed: Sep. 21, 2022

(65) Prior Publication Data

US 2023/0102720 A1 Mar. 30, 2023

(30) Foreign Application Priority Data

Sep. 24, 2021 (KR) ..... 10-2021-0126262

(51) Int. Cl.
*D03D 15/49* (2021.01)
*D03D 1/00* (2006.01)

(52) U.S. Cl.
CPC ..... *D03D 15/49* (2021.01); *D03D 1/00* (2013.01); *D10B 2503/04* (2013.01); *D10B 2505/12* (2013.01)

(58) Field of Classification Search
CPC ..... B23B 27/12; B23B 5/024; B32B 2471/00; D02G 3/445; D02G 3/446; D03D 1/00; D10B 2503/04; D10B 2505/12; C09D 109/08; Y10T 428/23993; D06N 7/0073;
(Continued)

(56) References Cited

U.S. PATENT DOCUMENTS 5,069,941 A * 12/1991 Ohmori ..... D06M 15/277 427/393.4
5,118,430 A * 6/1992 Rebouillat ..... D06M 15/233 252/8.84

(Continued)

FOREIGN PATENT DOCUMENTS

KR 100415731 B1 1/2004
KR 100538139 B1 12/2005

(Continued)

*Primary Examiner* — Marla D Mcconnell
*Assistant Examiner* — Christine X Nisula
(74) *Attorney, Agent, or Firm* — Fox Rothschild LLP

(57) ABSTRACT

Disclosed herein, inter alia, is a flooring woven fabric. The flooring woven fabric includes a fabric layer including bulked continuous filaments (BCFs) having crimp and a polymer resin composition. The fabric layer includes a woven yarn of BCFs and the polymer resin composition is applied on the top portion of the fabric layer such that the polymer resin to form a coating layer. The polymer resin composition of the coating layer may penetrate between the BCFs and yarns made of BCFs. As such, the flooring woven fabric may have improved the wear resistance to strengthen the surface properties and positioning the coating layer to block the penetration of liquid contaminants at the same time, thereby improving the decontamination performance.

10 Claims, 1 Drawing Sheet

(58) Field of Classification Search
CPC .. D06N 7/0071; D06N 7/0068; D06N 7/0065; D06N 7/0076
See application file for complete search history.

(56) References Cited

U.S. PATENT DOCUMENTS

| | | | | |
|---|---|---|---|---|
| 5,539,015 | A * | 7/1996 | Horii | D06N 3/0059 524/192 |
| 5,965,232 | A * | 10/1999 | Vinod | B32B 5/06 442/79 |
| 2004/0129333 | A1* | 7/2004 | Samel | D03D 23/00 139/383 R |
| 2004/0198120 | A1* | 10/2004 | Scott | B32B 27/36 442/268 |
| 2013/0059495 | A1 | 3/2013 | Dempster et al. | |
| 2015/0125649 | A1* | 5/2015 | Lunsford | D06N 7/0073 524/522 |
| 2018/0094101 | A1* | 4/2018 | Kim | C08K 3/26 |
| 2021/0015284 | A1* | 1/2021 | Matsumura | B32B 5/024 |
| 2023/0304219 | A1* | 9/2023 | Mandawewala | D01F 8/14 |

FOREIGN PATENT DOCUMENTS

| | | | |
|---|---|---|---|
| KR | 2012-0077221 | A | 7/2012 |
| KR | 2015-0016083 | A | 2/2015 |
| KR | 101989521 | B1 | 6/2019 |
| WO | 2017-051395 | A1 | 3/2017 |

* cited by examiner

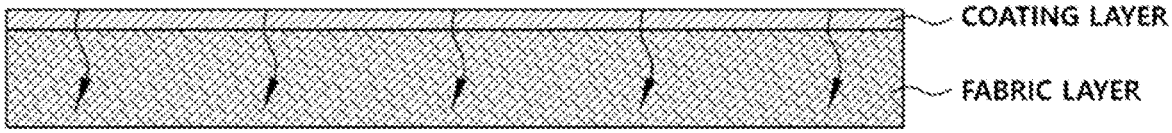
COATING LAYER
FABRIC LAYER

FLOORING WOVEN FABRIC

CROSS-REFERENCE TO RELATED APPLICATION

This application claims under 35 U.S.C. § 119(a) the benefit of priority to Korean Patent Application No. 10-2021-0126262 filed on Sep. 24, 2021, the entire contents of which are incorporated herein by reference.

TECHNICAL FIELD

The present invention relates to a flooring woven fabric preventing contamination while providing an exterior design pattern.

BACKGROUND

A tufted carpet of a tufting structure including a plurality of piles or a nonwoven carpet of needle punching have been mainly used as a conventional automotive flooring fabric.

However, in the case of conventional flooring fabrics, there has been a problem in that solid foreign substances such as sand, etc. are interposed between piles or raised layers and remain, and fine dust is caused inside a vehicle since it is difficult to completely remove them even if they are physically brushed off. In the case of liquid contaminants, there has been a problem in that they are permeated into the inside of the piles and penetrated into the floor under the piles, causing mold or bacteria to occur. With a simple pile structure, there are limitations in the realization of design and pattern so that there has been a problem in that there is a limit to the improvement of merchantability in terms of appearance.

SUMMARY

In preferred aspects, provided is a flooring woven fabric that include: a fabric layer comprising a bulked continuous filaments (BCFs) having crimp; and a polymer resin composition penetrating the fabric layer and binding the bulked continuous filaments.

The object of the present invention is not limited to the object mentioned above. The object of the present invention will become more apparent from the following description, and will be realized by means and combinations thereof described in the claims.

In an aspect, provided is a flooring woven fabric that includes: a fabric layer including bulked continuous filaments (BCFs) having crimp; and a polymer resin composition penetrating the fabric layer and binding the bulked continuous filaments.

The fabric layer may preferably include a woven yarn made of the bulked continuous filaments (BCFs).

Each of the bulked continuous filament (BCF) may have a crimp rate of about 5 to 30%.

Each of the bulked continuous filament (BCF) may have a fineness of about 10 to 50 deniers (D).

Each of the bulked continuous filament (BCF) may have a twisting number of about 100 to 200 twists/m.

The warp and weft of the fabric layer may respectively have a weaving density of about 10 to 50 counts/inch.

The fabric layer may have a weight of about 400 to 1,000 $g/m^2$.

The polymer resin composition may comprise: an amount of about 30 to 50% by weight of an acrylate-based resin; an amount of about 1 to 5% by weight of acrylic acid; an amount of about 2 to 5% by weight of additives; and an amount of about 40 to 65% by weight of water based on 100% by weight of the total polymer resin composition.

The polymer resin composition may further comprise an amount of about 1 to 10% by weight of an antifouling agent.

The polymer resin composition may have a weight of about 80 to 150 $g/m^2$.

The acrylate-based resin may have a glass transition temperature (Tg) of greater than about −60° C. to less than about 30° C.

The polymer resin composition may have a viscosity of about 1,000 to 6,000 mPa·S.

In an aspect, provided is a vehicle interior material including the flooring woven fabric as described herein.

Also provided is a vehicle including the flooring woven fabric as described herein.

Other aspects of the invention are disclosed infra.

The flooring woven fabric according to various exemplary embodiments of the present invention can provide an exterior design pattern and have excellent surface abrasion properties by including a fabric layer in which a yarn composed of a bulked continuous filament (BCF) having crimp properties is woven. Further, the flooring woven fabric according to various exemplary embodiments of the present invention may improve wear resistance by friction to strengthen the surface properties and positioning the coating layer to block the penetration of liquid contaminants at the same time, thereby improving the decontamination performance by coating a coating layer containing a polymer resin composition on the top portion of the fabric layer and allowing a polymer resin contained in the coating layer to penetrate between the yarns in the fabric layer to fix the yarns, thereby improving the bonding force.

The effects of the present invention are not limited to the above-mentioned effects. It should be understood that the effects of the present invention include all effects that can be inferred from the following description.

BRIEF DESCRIPTION OF THE DRAWINGS

FIG. 1 shows a cross-sectional view of a flooring woven fabric according to an exemplary embodiment of the present invention.

DETAILED DESCRIPTION

The above objects, other objects, features and advantages of the present invention will be easily understood through the following preferred embodiments related to the accompanying drawings. However, the present invention is not limited to the embodiments described herein and may be embodied in other forms. Rather, the embodiments introduced herein are provided so that the disclosed content may become thorough and complete, and the spirit of the present invention may be sufficiently conveyed to those skilled in the art.

The similar reference numerals have been used for similar elements while explaining each drawing. In the accompanying drawings, the dimensions of the structures are illustrated after being enlarged than the actual dimensions for clarity of the present invention. Terms such as first, second, etc. may be used to describe various components, but the components should not be limited by the terms. The terms are used only for the purpose of distinguishing one component from another component. For example, a first component may be referred to as a second component, and similarly, the second component may also be referred to as the first component, without departing from the scope of rights of the present invention. The singular expression includes the plural expression unless the context clearly dictates otherwise.

In the present specification, terms such as "comprise", "have", etc. are intended to designate that a feature, number, step, operation, component, part, or a combination thereof described in the specification exists, but it should be understood that it does not preclude the possibility of the existence or addition of one or more other features, numbers, steps, operations, components, parts, or combinations thereof. Further, when a part of a layer, film, region, plate, etc. is said to be "on" other part, this includes not only the case where it is "directly on" the other part but also the case where there is another part in the middle thereof. Conversely, when a part of a layer, film, region, plate, etc. is said to be "under" other part, this includes not only the case where it is "directly under" the other part, but also the case where there is another part in the middle thereof.

Unless otherwise specified, since all numbers, values, and/or expressions expressing quantities of components, reaction conditions, polymer compositions and formulations used in the present specification are approximate values reflecting various uncertainties of the measurement that arise in obtaining these values among others in which these numbers are essentially different, they should be understood as being modified by the term "about" in all cases. Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Further, when a numerical range is disclosed in this description, such a range is continuous, and includes all values from the minimum value of such a range to the maximum value including a maximum value, unless otherwise indicated. Furthermore, when such a range refers to an integer, all integers including from the minimum value to the maximum value including a maximum value are included, unless otherwise indicated. In the present specification, when a range is described for a variable, it will be understood that the variable includes all values including the end points described within the stated range. For example, the range of "5 to 10" will be understood to include any subranges, such as 6 to 10, 7 to 10, 6 to 9, 7 to 9, and the like, as well as individual values of 5, 6, 7, 8, 9 and 10, and will also be understood to include any value between valid integers within the stated range, such as 5.5, 6.5, 7.5, 5.5 to 8.5, 6.5 to 9, and the like. Also, for example, the range of "10% to 30%" will be understood to include subranges, such as 10% to 15%, 12% to 18%, 20% to 30%, etc., as well as all integers including values of 10%, 11%, 12%, 13% and the like up to 30%, and will also be understood to include any value between valid integers within the stated range, such as 10.5%, 15.5%, 25.5%, and the like.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Provided herein is, inter alia, flooring woven fabric that can provide an external design pattern and has excellent surface abrasion properties and decontamination performance in the case of a flooring woven fabric comprising: a fabric layer in which a yarn composed of a bulked continuous filament (BCF) having crimp properties is woven; and a coating layer positioned on the fabric layer to contain a polymer resin composition.

FIG. 1 is a cross-sectional view of a flooring woven fabric according to the present invention. The flooring woven fabric includes: a fabric layer including bulked continuous filaments (BCF) having crimp; and a polymer resin composition penetrating the fabric layer and binding the bulked continuous filaments.

The fabric layer included in the flooring woven fabric may be a form in which a yarn composed of a bulked continuous filament (BCF), preferably a yarn twisted with BCF is woven. Through this, there are advantages of enabling surface abrasion properties to be also improved as well as not only determining the shape and pattern of the overall flooring woven fabric, but also enabling various colors to be implemented.

The bulked continuous filament (BCF) may include a bulky continuous type synthetic fiber. For example, the bulked continuous filament (BCF) can be manufactured by heating a specific fiber to a certain temperature to form forms such as wrinkles, etc., thereby forming a bulky fiber, giving crimp properties to the bulky fiber, and cooling the bulky fiber to which crimp properties are given.

There is an advantage in that elongation and softness can be imparted to the fabric layer by using the bulked continuous filament (BCF) in order to manufacture the fabric layer.

The type of fiber used to manufacture the bulked continuous filament (BCF) may include one that can be used to be manufactured into the fabric layer according to the present invention. Particularly, a thermoplastic fiber including one or more fibers selected from the group consisting of nylon-based fibers, PET-based fibers, and TPO-based fibers may be used as the bulked continuous filament (BCF) without limitation.

The bulked continuous filament (BCF) may have crimp properties so that it can be expressed as a crimp rate (Crimp). The bulked continuous filament (BCF) may produce a soft fabric layer to be manufactured by appropriately adjusting the crimp rate, thereby having latent crimpability as well as shrinking/restoring power and softness of the yarn manufactured by twisting it.

The bulked continuous filament (BCF) may have a crimp rate of about 5 to 30%, preferably about 10 to 20%. When the crimp rate is less than the predetermined value, e.g., less than about 5%, the surface of the yarn manufactured by twisting it is smooth and has no bulkiness to have a disadvantage in that cushioning and elongation in the fabric layer are lowered. When the crimp rate is greater than the predetermined value, e.g., greater than about 30%, the yarn shrinkage and restoring force due to heat and load may be excessively formed so that there is a disadvantage in that the form of the fabric layer may be deformed after being manufactured into the fabric layer.

Further, the bulked continuous filament (BCF) may preferably have a fineness of about 10 D to 50 D. The conventional filaments for fabrics used for automobile seats or clothing usually have a fineness of about 1 D to 5 D, but the filaments for fabrics having the above fineness size are too thin and soft so that there is a disadvantage in that the wear resistance as standard for flooring fabrics or automobile mats cannot be satisfied. Therefore, the bulked continuous filament (BCF) according to an exemplary embodiment of the present invention preferably may suitably have a fineness of 10 D or greater. However, when the fineness of the bulked continuous filament (BCF) is greater than the predetermined value, e.g., greater than about 50 D, the filaments become so rough that there is a disadvantage in that weaving workability and uniformity deteriorate.

The fabric layer according to an exemplary embodiment of the present invention may be manufactured by weaving a yarn twisted with a bulked continuous filament (BCF) having the above characteristics. When the yarn twisted with the bulked continuous filament (BCF) is woven to manufacture a fabric layer, there are advantages in that it not only gives elongation enough to enable molding during manufacturing of the fabric layer, but also fixes a yarn shape twisted with filaments, thereby enabling wear of the yarn due to friction to be prevented.

Preferably, the bulked continuous filament (BCF) may produce a yarn by twisting 2 to 4 strands, and at this time, the twisting number when the bulked continuous filament (BCF) is twisted may be about 100 to 200 twists/m. When the twisting number is less than about 100 twists/m, the effect of fixing the yarn shape may be reduced so that there is a problem in that the overall wear resistance performance of the fabric layer due to friction deteriorates. When the twisting number is greater than about 200 twists/m, the twisting operation may not be smooth so that there is a problem in that the workability deteriorates.

The fabric layer according to the present invention may be manufactured by weaving the yarn twisted with the bulked continuous filament (BCF). The weaving method may include a normal weaving method that can be preferably used, but is not limited to a specific weaving method.

At this time, the warp and weft of the fabric layer to be woven may each have a weaving density of about 10 to 50 counts/inch. When the weaving density is less than about 10 counts/inch, the distance between the yarn and the yarn may be widened so that, when the coating layer is formed by coating the fabric layer with the polymer resin composition later, there is a disadvantage in that the polymer resin composition may leak out between the yarns in the fabric layer to cause defects. When the weaving density is greater than 50 counts/inch, the weaving operation may not be smooth due to too severe friction between the yarn and the yarn during weaving so that there are disadvantages in that defects may occur on the fabric surface, and the manufacturing cost may be unnecessarily increased.

The fabric layer woven with the yarn may have a weight of about 400 to 1,000 g/m$^2$. When the weight of the fabric layer is less than about 400 g/m$^2$, the amount of yarn in the fabric layer may not be sufficient so that, when the coating layer is formed by coating the fabric layer with the polymer resin composition later, there is a problem in that the polymer resin composition may leak out between the yarns in the fabric layer to cause defects. When the weight of the fabric layer is greater than about 400 to 1,000 g/m$^2$, the weaving operation may not be smooth so that there are problems in that defects may occur on the fabric surface, and the manufacturing cost may be unnecessarily increased.

The coating layer may be positioned on the fabric layer by coating the polymer resin composition on the fabric layer, thereby forming the coating layer thereon. As shown in FIG. 1, the coating layer has advantages of improving wear resistance by friction to strengthen the surface properties and blocking the penetration of liquid contaminants to enable the decontamination performance to be improved at the same time by coating the polymer resin composition so that a polymer resin contained therein penetrates between the yarns in the fabric layer and fixes the yarns to improve the bonding force.

The polymer resin composition contained in the coating layer may comprise: an amount of about 30 to 50% by weight of an acrylate-based resin; an amount of about 1 to 5% by weight of acrylic acid; an amount of about 2 to 5% by weight of additives; and an amount of about 40 to 65% by weight of water based on 100% by weight of the polymer resin composition.

The acrylate-based resin may be a resin that can easily penetrate between the yarns in the fabric layer and improve the fixing force of the yarns through acrylic crosslinking, for example, one or more resins selected from the group consisting of an acrylate copolymer, a urethane acrylate resin, and an acrylic acid resin. The acrylate-based resin may preferably include an acrylate copolymer that is easy to penetrate into the fiber.

The acrylate-based resin has an advantage of being able to adjust the mechanical strength and intermolecular bonding force of the acrylate-based resin by adjusting the glass transition temperature (Tg). Accordingly, the acrylate-based resin may preferably have a glass transition temperature (Tg) of greater than about −60° C. to less than about 30° C. When the glass transition temperature of the acrylate-based resin is too low outside the above range, the hardness of the acrylate-based resin may be too low so that there is a disadvantage in that the wear resistance performance of the flooring woven fabric rapidly deteriorates. When the glass transition temperature of the acrylate-based resin is too high outside the above range, the hardness of the acrylate-based resin may be too high so that there are disadvantages in that not only the coating operation does not work smoothly, but also a whitening phenomenon may occur while the acrylate-based resin wears out when the flooring woven fabric is worn out.

The acrylate-based resin may have a content of about 30 to 50% by weight based on 100% by weight of the polymer resin composition. When the content of the acrylate-based resin is less than 30% by weight based on 100% by weight of the polymer resin composition, wear resistance may be reduced, and when the content of the acrylate-based resin is greater than about 50% by weight based on 100% by weight of the polymer resin composition, the viscosity increases so that there is a problem in that the fabric layer cannot be uniformly coated.

The acrylic acid may be contained in the polymer resin composition to secure the stability of a crosslinking reaction of the acrylate-based resin.

The acrylic acid may have a content of about 1 to 5% by weight based on 100% by weight of the polymer resin composition. When the content of the acrylic acid is less than about 1% by weight based on 100% by weight of the polymer resin composition, the crosslinking reaction may not be sufficiently performed so that there is a disadvantage in that, since the crosslinking reaction of the acrylate-based resin is not sufficiently performed, wear resistance is lowered. When the content of the acrylic acid is greater than about 5% by weight based on 100% by weight of the polymer resin composition, the content is unnecessarily increased so that there is a problem in that the cost increases.

The additives may include normal additives that can be used in the present invention, for example, a thickener that increases viscosity, a catalyst that promotes a crosslinking reaction, a foaming agent that properly foams the resin in order to improve coating uniformity, etc.

The additives may have a content of about 2 to 5% by weight based on 100% by weight of the polymer resin composition. When the content of the additives is less than about 2% by weight based on 100% by weight of the polymer resin composition, chemicals cannot be uniformly coated on the entire fabric due to low viscosity or no foaming. When the content of the additives is greater than about 5% by weight based on 100% by weight of the polymer resin composition, as expensive additives are injected in large amounts, the production cost increases and the viscosity increases so that there is a disadvantage in that an aggregation phenomenon of the chemicals may occur during coating.

The water may be included to dilute the polymer resin composition in order to secure the production stability of the polymer resin composition.

The water may have a content of about 40 to 65% by weight based on 100% by weight of the total polymer resin composition. When the content of water is less than about 40% by weight based on 100% by weight of the polymer resin composition, the polymer resin may be precipitated, and if when content of water is greater than about 65% by weight based on 100% by weight of the polymer resin composition, it is difficult to dry the fabric properly after coating.

Further, the polymer resin composition may additionally comprise an antifouling agent capable of imparting water/oil repellent antifouling properties.

The antifouling agent may have a content of about 1 to 10% by weight based on 100% by weight of the total polymer resin composition. When the content of the antifouling agent is less than about 1% by weight based on 100% by weight of the polymer resin composition, it is difficult to obtain an effect of improving fabric contamination due to liquid contaminants, and when the content of the antifouling agent is greater than about 10% by weight based on 100% by weight of the polymer resin composition, it is difficult to form a uniform resin surface so that there are disadvantages of poor appearance and an increase in the production cost.

The polymer resin composition including the components satisfying the above characteristics can improve the penetration force and fixation power in the yarn by implementing an appropriate viscosity range. Preferably, the polymer resin composition may have a viscosity of about 1,000 to 6,000 mPa·S. When the viscosity of the polymer resin composition is less than about 1,000 mPa·S, the polymer resin composition may flow through between the yarns in the fabric layer, and when the viscosity of the polymer resin composition is greater than about 6,000 mPa·S, the polymer resin composition may not pass through between the yarns in the fabric layer and remains only on the fabric surface so that defects may occur in the appearance of the fabric.

The coating layer manufactured by coating the polymer resin composition satisfying the above characteristics on the fabric layer may have a weight of about 80 to 150 g/m$^2$. When the weight of the coating layer is less than about 80 g/m$^2$, the wear resistance by friction cannot be sufficiently secured, and when the weight is greater than about 150 g/m$^2$, the hardness of the flooring woven fabric may be too high due to the coating layer so the coating operation of the coating layer may not be smooth.

The flooring woven fabric according to an exemplary embodiment of the present invention may provide an exterior design pattern and has excellent surface abrasion properties by including a fabric layer in which a yarn manufactured by twisting a bulked continuous filament (BCF) having crimp properties is woven. Further, the flooring woven fabric according to an exemplary embodiment of the present invention may improve the wear resistance by friction to strengthen the surface properties and positioning the coating layer to block the penetration of liquid contaminants at the same time, thereby improving the decontamination performance by coating a coating layer containing a polymer resin composition on the top portion of the fabric layer and allowing a polymer resin contained in the coating layer to penetrate between the yarns in the fabric layer to fix the yarns, thereby improving the bonding force.

EXAMPLE

The present invention will be described in more detail through the following Examples. The following Examples are only examples to help the understanding of the present invention, and the scope of the present invention is not limited thereto.

Examples 1 and 2, and Comparative Examples 1 to 10: Manufacturing of Flooring Woven Fabrics The fabric layers were manufactured as follows.

Particularly, yarns were manufactured by twisting bulked continuous filaments (BCFs) satisfying the crimp rates and finesses as shown in Table 1 below so that the twisting numbers shown in Table 1 below were satisfied. Next, the fabric layers were manufactured by weaving the manufactured yarns by the Rapier weaving method.

Further, after preparing polymer resin compositions including 40% by weight of an acrylate copolymer (see Table 1 below for Tg conditions), which is an acrylate-based resin, 3% by weight of acrylic acid, 2% by weight of additives including a thickener, a crosslinking agent, etc., and 65% by weight of water, based on 100% by weight of the polymer resin composition, the polymer resin compositions were coated on the fabric layers to manufacture coating layers.

Accordingly, flooring woven fabrics including the fabric layers that satisfy the weights shown in Table 1 below respectively and the coating layers positioned on the fabric layers were finally manufactured.

TABLE 1

| | Composition | | |
|---|---|---|---|
| Classification | Fabric layer (BCF; Nylon) | BCF Crimp rate (%) | Coating layer (Acrylate Copolymer) |
| Example 1 | 450 g/m$^2$ (Fineness of 20D, Twisting number of 160 twists/m) | 10% | 100 g/m$^2$ (Tg −20° C.) |
| Example 2 | 450 g/m$^2$ (Fineness of 40D, Twisting number of 200 twists/m) | 20% | 130 g/m$^2$ (Tg −20° C.) |
| Comparative Example 1 | 300 g/m$^2$ (Fineness of 20D, Twisting number of 160 twists/m) | 10% | 100 g/m$^2$ (Tg −20° C.) |
| Comparative Example 2 | 450 g/m$^2$ (Fineness of 20D, No twisting number) | 10% | 100 g/m$^2$ (Tg −20° C.) |
| Comparative Example 3 | 450 g/m$^2$ (Fineness of 3D, | Not applied | 100 g/m$^2$ (Tg −20° C.) |

TABLE 1-continued

| Classification | Composition | | |
|---|---|---|---|
| | Fabric layer (BCF; Nylon) | BCF Crimp rate (%) | Coating layer (Acrylate Copolymer) |
| | Twisting number of 160 twists/m) | | |
| Comparative Example 4 | 450 g/m$^2$ (Fineness of 40D, Twisting number of 100 twists/m) | Not applied | 100 g/m$^2$ (Tg −20° C.) |
| Comparative Example 5 | 450 g/m$^2$ (Fineness of 20D, Twisting number of 160 twists/m) | 10% | 50 g/m$^2$ (Tg −20° C.) |
| Comparative Example 6 | 450 g/m$^2$ (Fineness of 20D, Twisting number of 160 twists/m) | 10% | 230 g/m$^2$ (Tg −20° C.) |
| Comparative Example 7 | 450 g/m$^2$ (Fineness of 20D, Twisting number of 160 twists/m) | 10% | 100 g/m$^2$ (Tg 30° C.) Increase in strength of acrylic co-polymer resin |
| Comparative Example 8 | 450 g/m$^2$ (Fineness of 20D, Twisting number of 160 twists/m) | 10% | 100 g/m$^2$ (Tg −60° C.) Decrease in strength of acrylic co-polymer resin |
| Comparative Example 9 | 450 g/m$^2$ (Fineness of 20D, Twisting number of 160 twists/m) | 10% | 100 g/m$^2$ Urethane Acrylate Resin |
| Comparative Example 10 | 450 g/m$^2$ (Fineness of 20D, Twisting number of 160 twists/m) | 10% | 100 g/m$^2$ Transparent films such as PVC, TPE, PE |

Comparative Examples 11 and 12: Conventional Flooring Fabric

A tufted carpet with a BCF tufting structure having a pile weight of 450 g/m$^2$ (Comparative Example 11) and a PET needle punching nonwoven fabric having a weight of 450 g/m$^2$ (Comparative Example 12) were prepared.

Evaluation Criteria and Evaluation Method

Wear resistance (grade)=Measured by Taber Abrasion Tester (MS 343-17), using H-18 abrasive wheels, 1 kg of load, and wear resistance measurement by treatment of 1500 cycles, passing grade 3 or higher Grade 1: A state in which severe cut, tear, or damage of piles is confirmed Grade 2: A state in which the piles and fibers are worn out and fluffs and boundary surfaces are clearly observed Grade 3: A state in which wear of the piles and fibers occurs, but fluffs and boundary surfaces are not clear Grade 4: A state in which wear of the piles or fibers is not clearly observed with the naked eye Grade 5: A state in which wear of the piles or fibers is not observed Fabric elongation (%)=After taking a specimen with a 250 mm×50 mm size from a carpet fabric to draw two marked lines with an interval of 100 mm centering around the central part of the specimen, and fixing the specimen to a tensile tester so that the clamp interval becomes 150 mm, the fixed specimen is tensioned at a rate of 200 mm/min to measure an elongation at the time of showing the maximum load. At this time, the elongation measures the rate of a change in the distance between the initial 100 mm marked lines.

Appearance and formability=Molded products using this material should not have defects such as fiber loss, tearing, cracks, color stains, deformation, wrinkles, etc.

1. There should be no defects impairing the appearance, such as flaws, irregularities, stickiness, color stains, dirtiness, and the like of appearance.
2. The color, pattern and feel of the carpet should not be different from the initial sample.
3. The carpet should be evenly closely adhered to the fiber layer, and there should be no defects such as tearing, cracks, or the like after molding.
4. The back side can be processed by heat fusion of a thermoplastic resin, a fiber material, or the like, but it should be melted uniformly and there should be no severe agglomeration.

Decontamination performance evaluation=After spreading it evenly over the entire area as much as possible while rubbing 30 g of standard silica sand on a sample of a 250 mm×250 mm size to penetrate it into a flooring woven fabric or a conventional flooring fabric, the sample is turned upside down to primarily remove silica sand, and repeatedly cleaned three times with a vacuum cleaner having a flow amount of 22 L/s. Then, the weight of the remaining silica sand on the fabric is measured, and the degree of contamination is judged by using it as a limit sample.

Residue performance evaluation=MS300-32 4.21 based (CODE B~H), passing grade 4 or higher After 30 seconds of applying 1 mL of B—Artificial sweat fluid, C—Black coffee, D—Regular milk, E—Regular coke, F—Grape juice, G—Ketchup, and H—Cooking oil onto test pieces, they are removed by white cotton cloth, and then the grade is judged according to the standard of AATCC 130 Decontamination Standard Edition.

Evaluation Results

After preparing the flooring woven fabrics according to Examples 1 and 2 and Comparative Examples 1 to 10 depending on the physical properties according to Table 1 above, and evaluating wear resistance, fabric elongation, and appearance and formability by the evaluation criteria and evaluation method described above, the evaluation results are shown in Table 2.

TABLE 2

| Classification | Physical properties | | |
|---|---|---|---|
| | Wear resistance (Wear of 1,500 cycles) | Fabric elongation (%) | Appearance and formability |
| Example 1 | Grade 3 | 70% | Good |
| Example 2 | Grade 3 to 4 | 60% | Good |
| Comparative Example 1 | Grade 2 | 60% | Hole size widening during molding |
| Comparative Example 2 | Grade 2 | 50% | Slightly lacking in wear resistance and elongation |
| Comparative Example 3 | Grade 1 | Less than 10% | Insufficient wear resistance, elongation/appearance (hole size widening) |
| Comparative Example 4 | Grade 3 | Less than 10% | High fineness fabrics lack in elongation |
| Comparative Example 5 | Grade 1 | 70% | Lack of wear resistance (low resin penetration amount) |
| Comparative Example 6 | Grade 3 | 70% | Poor appearance (resin that has not |

TABLE 2-continued

| Classification | Physical properties | | |
|---|---|---|---|
| | Wear resistance (Wear of 1,500 cycles) | Fabric elongation (%) | Appearance and formability |
| | | | been penetrated remains on the surface) |
| Comparative Example 7 | Grade 2 | 70% | Insufficient wear resistance (whitening phenomenon during wear) Decreased formability due to excessive coating strength |
| Comparative Example 8 | Grade 2 | 70% | Insufficient wear resistance due to reduced strength of coating layer resin |
| Comparative Example 9 | Grade 1 | 70% | Water-insoluble acrylic resin prevents penetration into fabric and forms a surface coating layer |
| Comparative Example 10 | Grade 2 | 70% | Poor appearance due to gloss and remaining resin and unsatisfactory wear resistance |

As shown in Tables 1 and 2 and the FIGURES above, a result of wear resistance test that the flooring woven fabric (Comparative Example 1) manufactured below the fabric layer weight range according to an exemplary embodiment of the present invention had a damaged fabric pattern and a widened hole size during molding. Further, as a result of wear resistance test that the flooring woven fabric (Comparative Example 2) manufactured without twisting the BCFs had a damaged fabric pattern, lacked elongation during molding, and had dropped wear resistance. Also, as a result of wear resistance test that the flooring woven fabric (Comparative Example 3) manufactured to be smaller than the fineness range of the BCF according to an exemplary embodiment of the present invention and not provided with crimping properties of the BCF had large sizes of holes widely opened between the fabrics so that the bottom of the fabric was visible, the elongation during molding was insufficient, and the wear resistance was also dropped. Further, the flooring woven fabric (Comparative Example 4) manufactured without being imparted crimping properties of BCF was a high-fineness fabric and had insufficient elongation.

Further, as a result of wear resistance test that the flooring woven fabric (Comparative Example 5) manufactured below the coating layer weight range according to an exemplary embodiment of the present invention had dropped wear resistance as the resin penetration amount decreased. Further, it could be confirmed as a result of wear resistance test that the flooring woven fabric (Comparative Example 6) manufactured above the coating layer weight range according to an exemplary embodiment of the present invention had a poor appearance since the resin that had not penetrated yet remained on the surface. Further, as a result of wear resistance test, the flooring woven fabric (Comparative Example 7) manufactured using, as a coating layer, one having a glass transition temperature of the acrylate copolymer resin in the polymer resin composition of 0° C. showed a whitening phenomenon so that the wear resistance was dropped, and the formability deteriorated due to excessive coating strength. Meanwhile, as a result of wear resistance test that the flooring woven fabric (Comparative Example 8) manufactured using, as a coating layer, one having a glass transition temperature of the acrylate copolymer resin in the polymer resin composition of −80° C. had dropped wear resistance due to a decrease in the strength of the coating layer. Further, in the case of flooring woven fabrics (Comparative Examples 9 and 10) including coating layers in which the polymer resin compositions were prepared from resins other than an acrylate-based resin, there were problems in that they not only had dropped wear resistance, but also did not allow the water-insoluble resin to penetrate into the fabric so that they had poor appearance and gloss.

On the other hand, in the case of the flooring woven fabrics (Examples 1 and 2) manufactured by satisfying the conditions according to an exemplary embodiment of the present invention, they not only had excellent wear resistance, but also had good appearance, formability, and fabric elongation.

Further, after performing decontamination performance evaluation from the flooring woven fabric according to Example 1 and typical flooring woven fabrics according to Comparative Examples 11 and 12, results of the evaluation are shown in Table 3 below, and after performing residue performance evaluation, results of the evaluation are shown in Table 4.

TABLE 3

| Classification | Results of decontamination performance evaluation |
|---|---|
| Example 1 | Appearance of grade 3 or 4 level, sand residue amount of 0.3 g (1% remained) |
| Comparative Example 11 | Appearance of grade 2 level, sand residue amount of 3.2 g (10.7% remained) |
| Comparative Example 12 | Appearance of grade 1 to 2 level, sand residue amount of 6.1 g (20.3% remained) |

TABLE 4

| Classification | Residue performance evaluation | | | |
|---|---|---|---|---|
| | Black coffee | Ketchup | Coke | Cooking oil |
| Example 1 | Grade 4 to 5 | Grade 4 to 5 | Grade 4 to 5 | Grade 4 to 5 |
| Comparative Example 11 | Grade 4 to 5 | Grade 3 | Grade 4 to 5 | Grade 4 to 5 |
| Comparative Example 12 | Grade 4 to 5 | Grade 3 to 4 | Grade 4 to 5 | Grade 4 to 5 |

As shown in Table 3 above, in the case of typical flooring materials (Comparative Examples 11 and 12), the decontamination properties were dropped by confirming that both of the residual amounts of sand exceeded 10% or greater. However, in the case of the flooring woven fabric (Example 1) manufactured according to an exemplary embodiment of the present invention, it could be confirmed that the flooring woven fabric had excellent decontamination properties by confirming that it not only had a high appearance level, but also had a very low residual amount of sand at 1%.

Further, as shown in Table 4 above, in the case of typical flooring materials (Comparative Examples 11 and 12) that the ketchup removal performance was relatively poor, but it could be confirmed in the case of the flooring woven fabric manufactured according to an exemplary embodiment of the present invention (Example 1) that the ketchup removal performance was also excellent.

Particularly, the flooring woven fabrics according to various exemplary embodiments of the present invention enables the realization of an exterior design pattern and has excellent surface abrasion properties by including a fabric layer in which a yarn manufactured by twisting bulked continuous filaments (BCFs) having crimp properties is woven. Further, the flooring woven fabrics according to various exemplary embodiments of the present invention improves the wear resistance by friction to strengthen the surface properties and positions the coating layer to block the penetration of liquid contaminants at the same time, thereby improving the decontamination performance by coating a coating layer containing a polymer resin composition on the top portion of the fabric layer and allowing a polymer resin contained in the coating layer to penetrate between the yarns in the fabric layer to fix the yarns, thereby improving the bonding force.

What is claimed is:

1. A flooring woven fabric comprising:

a fabric layer comprising bulked continuous filaments (BCFs) having crimp; and a polymer resin composition penetrating the fabric layer and binding the plurality of the bulked continuous filaments (BCFs);

wherein the polymer resin composition comprises:

an amount of 30 to 50% by weight of an acrylate-based resin;

an amount of 1 to 5% by weight of acrylic acid;

an amount of 2 to 5% by weight of additives; and an amount of 40 to 65% by weight of water based on 100% by weight of the polymer resin composition, wherein the polymer resin composition has a viscosity of 1,000 to 6,000 mPa·S, wherein each of the bulked continuous filament (BCF) has a twisting number of 100 to 200 twists/m.

2. The flooring woven fabric of claim 1, wherein the fabric layer comprises a woven yarn made of the bulked continuous filaments (BCFs).

3. The flooring woven fabric of claim 1, wherein each of the bulked continuous filament (BCF) has a crimp rate of 5 to 30%.

4. The flooring woven fabric of claim 1, wherein each of the bulked continuous filament (BCF) has a fineness of 10 to 50 Denier.

5. The flooring woven fabric of claim 1, wherein the warp and weft of the fabric layer respectively have a weaving density of 10 to 50 counts/inch.

6. The flooring woven fabric of claim 1, wherein the fabric layer has a weight of 400 to 1,000 g/m$^2$.

7. The flooring woven fabric of claim 1, wherein the polymer resin composition further comprises an amount of 1 to 10% by weight of an antifouling agent.

8. The flooring woven fabric of claim 1, wherein the polymer resin composition has a weight of 80 to 150 g/m$^2$.

9. The flooring woven fabric of claim 1, wherein the acrylate-based resin has a glass transition temperature (Tg) of greater than about −60° C. to less than 30° C.

10. A vehicle comprising a flooring woven fabric of claim 1.

* * * * *